US010202780B2

(12) United States Patent
Parker

(10) Patent No.: US 10,202,780 B2
(45) Date of Patent: Feb. 12, 2019

(54) ROSTRUM SUPPORT STRUCTURE

(71) Applicant: STEELDECK INDUSTRIES LIMITED, London (GB)

(72) Inventor: Nigel Matthew Parker, London (GB)

(73) Assignee: STEELDECK INDUSTRIES LIMITED (GB)

( * ) Notice: Subject to any disclaimer, the term of this patent is extended or adjusted under 35 U.S.C. 154(b) by 0 days.

(21) Appl. No.: 14/377,549

(22) PCT Filed: Feb. 8, 2013

(86) PCT No.: PCT/GB2013/050293
§ 371 (c)(1),
(2) Date: Aug. 8, 2014

(87) PCT Pub. No.: WO2013/117937
PCT Pub. Date: Aug. 15, 2013

(65) Prior Publication Data

US 2015/0013236 A1 Jan. 15, 2015

(30) Foreign Application Priority Data

Feb. 8, 2012 (GB) ..... 1202192.9

(51) Int. Cl.
*E04H 3/12* (2006.01)
*E04H 3/28* (2006.01)
*E04H 3/30* (2006.01)

(52) U.S. Cl.
CPC ..... *E04H 3/28* (2013.01); *E04H 3/123* (2013.01); *E04H 3/30* (2013.01)

(58) Field of Classification Search
CPC .. E04H 3/28; E04H 3/30; E04H 3/123; E04H 3/126
USPC ..... 52/9, 10, 183, 67, 645, 646
See application file for complete search history.

(56) References Cited

U.S. PATENT DOCUMENTS 1,964,612 A * 6/1934 Wetzel ..... E04H 3/126 297/170
1,964,613 A * 6/1934 Wetzel ..... E04H 3/126 297/170
RE19,373 E * 11/1934 Wetzel ..... E04H 3/126 52/10

(Continued)

FOREIGN PATENT DOCUMENTS

DE 35 03 769 A1 8/1986
DE 10 2009 030189 A1 12/2010

(Continued)

OTHER PUBLICATIONS

International Search Report and Written Opinion dated May 10, 2013 issued in corresponding International patent application No. PCT/GB2013/050293.

(Continued)

*Primary Examiner* — Brent W Herring
(74) *Attorney, Agent, or Firm* — Ostrolenk Faber LLP

(57) ABSTRACT

A rostrum support structure comprising a plurality of frame units (10, 20, 30, 40, 50) which can be stacked with respect to one another, at least one support member being provided for directly supporting at least two of the frame units when stacked so that they can be lifted together. The at least one support member is preferably in the form of a flat plate.

20 Claims, 6 Drawing Sheets

(56) References Cited

U.S. PATENT DOCUMENTS 2,070,471 A * 2/1937 Condon ..... E06B 9/063 52/125.1
2,147,564 A * 2/1939 Vance ..... E04H 3/123 52/10
2,183,056 A * 12/1939 Albach et al. ..... 52/9
2,846,738 A * 8/1958 Walworth et al. ..... 52/9
2,870,492 A * 1/1959 Chervenka ..... E04H 3/123 52/143
2,968,842 A * 1/1961 Murphy ..... E04H 3/123 180/19.1
2,987,111 A * 6/1961 Walworth ..... 52/9
2,990,587 A * 7/1961 Murphy ..... 52/10
3,069,733 A * 12/1962 Murphy ..... 52/10
3,103,707 A * 9/1963 Lappin ..... E04H 3/126 280/43.16
3,107,399 A * 10/1963 Murphy ..... 52/10
3,335,533 A * 8/1967 Bahr ..... 52/126.1
3,478,473 A * 11/1969 Hoven ..... E04H 3/123 52/9
3,608,251 A * 9/1971 Scaggs ..... E04H 3/123 52/9
3,667,171 A * 6/1972 McClelland et al. ..... 52/9
4,041,655 A * 8/1977 Pari ..... 52/9
4,527,362 A * 7/1985 Tobey ..... B64G 9/00 52/646
4,571,895 A * 2/1986 Lyman, Jr. ..... 52/9
4,934,113 A 6/1990 Hall et al. ..... 52/7
4,979,340 A * 12/1990 Wilson ..... E04H 3/126 182/113
5,050,353 A * 9/1991 Rogers ..... E04H 3/28 52/118
5,069,007 A * 12/1991 Paddock ..... E04H 3/123 52/126.1
5,369,918 A * 12/1994 Beu ..... 52/9
5,381,873 A * 1/1995 Kniefel ..... E04H 3/126 182/152
5,459,964 A * 10/1995 Doublet ..... A47C 1/126 52/7
6,393,769 B1 * 5/2002 Mertik ..... E04H 3/28 296/162
6,539,672 B1 * 4/2003 Frost ..... 52/9
6,598,351 B2 * 7/2003 Hallberg ..... 52/9
8,407,943 B2 * 4/2013 Sudkamp ..... E04H 3/123 182/223
9,332,846 B2 * 5/2016 Koch ..... A47C 1/126
9,540,831 B2 * 1/2017 Koch ..... E04H 3/126
9,790,698 B2 * 10/2017 Koch ..... E04H 3/126
9,809,987 B2 * 11/2017 Koch ..... A47C 1/126
2004/0182012 A1 * 9/2004 Ahrens et al. ..... 52/9
2007/0144078 A1 * 6/2007 Frondelius ..... E04B 1/34305 52/67
2010/0043629 A1 * 2/2010 Carberry ..... E04H 9/10 89/36.02
2011/0099915 A1 * 5/2011 Sudkamp et al. ..... 52/9
2015/0121771 A1 * 5/2015 Koch ..... A47C 1/126 52/10
2016/0024809 A1 * 1/2016 Koch ..... E04H 3/126 52/10
2017/0081868 A1 * 3/2017 Koch ..... E04H 3/126

FOREIGN PATENT DOCUMENTS

GB 2 174 296 11/1986
GB 2474295 4/2011
JP 06057977 A * 3/1994 ..... E04H 3/12
JP H 10 184049 7/1998
JP 2000 073596 3/2000
WO WO 2008/149077 12/2008

OTHER PUBLICATIONS

U.K. Search Report issued in GB 1202192.9 dated Jun. 1, 2012.

* cited by examiner

ROSTRUM SUPPORT STRUCTURE

CROSS REFERENCE TO RELATED APPLICATIONS

The present application is a 35 U.S.C. § 371 National Phase conversion of PCT/GB2013/050293, filed Feb. 8, 2013, which claims benefit of United Kingdom Application No. 1202192.9, filed Feb. 8, 2012, the disclosure of which is incorporated herein by reference. The PCT International Application was published in the English language.

TECHNICAL FIELD OF THE INVENTION

The present invention relates to a rostrum and rostrum support structure which comprises a plurality of stackable frame units arranged so that decks can rest upon the frame units to create a rostrum.

BACKGROUND OF THE INVENTION

A rostrum support structure of this type is known for example from WO2008/149077 and also from GB 2474295.

In order to minimise the space occupied by the rostrum support structure when it is not in use, it is provided that the frame units can be stacked one inside another so that the stored volume is much smaller than the volume when the frame units are not stacked.

Rostrum support structures of this type have been successfully used, being installed in a fixed position in a space, for example a building, in which the rostrum is to be established so that the space can either be used as an auditorium or for other uses, when the rostrum support structure is in the stacked position.

The present inventor has realised that it would be beneficial to be able to transport a rostrum support structure or rostrum from one place to another, without being fixed in a particular place. In this way, a truly adaptable rostrum support structure or rostrum, for use in a wide variety of configurations and places can be provided. The present inventor has further realised that for safety and security during transport and to prevent damage to the frame units, each frame unit should be capable of being stably supported in the stacked position so that its weight is taken through an appropriate structure.

Conventionally, frame units are configured so that their weight is taken, when in use, through foot structures, one on either side, resting on the floor. Whereas such foot structures provide a strong and stable support for the respective part of a frame unit in use, the present inventor has realised that they can be difficult of access for lifting means and not necessarily conveniently spaced for lifting means. The present inventor has realised that a support structure can be provided for directly supporting at least two of the frame units so that they can be lifted together in a convenient manner.

SUMMARY OF THE INVENTION

Accordingly the present invention provides a rostrum support structure comprising a plurality of frame units which can be stacked with respect to one another, at least one support structure being provided for directly supporting at least two of the frame units when stacked so that they can be lifted together.

The rostrum support structure of the present invention may have the features of the support structure for a rostrum of GB 2474295 or WO 2008/149077. At least one frame unit and, suitably, all of the frame units of the present invention may have some or all of the features of the frame units of GB 2474295 or the A frames of WO 2008/149077.

Further, the invention provides a rostrum comprising a rostrum support structure according to either aspect of the invention, wherein at least one deck is supported on each frame unit.

Preferred and optional features of both aspects of the invention will be described further below.

The support member of the invention preferably directly supports all the frame units in the stacked position. Alternatively, more than one support member may be provided, though the number is preferably small, for example no more than two or three. By "directly" it is meant that the respective frame unit rests on or is supported by the support member, without interposition of another frame unit.

A frame unit for use with the present invention preferably comprises a floor contacting part, for example a foot, for contacting the floor or the ground in use. For example, the floor contacting part may comprise at least one member which extends in the direction in which frame units are stacked. Preferably, there are at least two floor contacting parts, suitably extending substantially parallel to one another, preferably one on each side, suitably spaced apart in a direction transverse to the stacking direction.

The stacking direction is defined as the direction in which frame units move with respect to one another to stack.

The support member may comprise any suitable material, being preferably formed of metal, for example steel. It may have any suitable form as explained below.

In a preferred embodiment, the support member comprises a member having substantial two dimensional extent. For example, the ratio of its length to its width may be less than 10:1, preferably less than 5:1. That is, the support member preferably has greater two-dimensional extent than, for example, a beam.

Preferably, the at least one support member has a depth in a direction which is parallel to a retraction direction, the depth being greater or equal to the depth of at least one frame unit in the retraction direction.

Preferably, the at least one support member has a width in a direction normal to a retraction direction, the width being greater than or equal to the distance in the retraction direction between the respective floor contacting parts of the widest frame unit to be supported by the support member.

In the embodiment (explained further below) in which the support member is integral with the largest of the frame units, the width is preferably greater than the distance normal to the retraction direction between the respective floor contacting parts of the widest frame unit to be received in the largest frame unit.

For example, the support member may comprise a substantially flat plate or a substantially flat structure comprising frame members extending substantially in a direction parallel to the retraction direction and/or in a direction transverse to the retraction direction.

By "flat" it is meant that the depth in a direction which, in use is normal to a floor surface on which the rostrum support structure is mounted, is preferably less than or equal to one tenth (preferably less than or equal to one fifteenth) of the width of the support member.

A plate member has the advantage that it is particularly simple to construct and can support a plurality of frame units on its surface in a simple fashion.

In a preferred embodiment, the plate member comprises at least one stiffener, preferably at the back or side(s) to give additional strength. Preferably, there is at least one wall or edge structure extending at an angle to the plane of the plate. Preferably, the plate has an upstanding wall or edge structure at at least one side and preferably on both sides. Preferably, there is an upstanding wall or edge structure at the rear. The plate may be formed by any suitable means, for example by bending or forming a starting plate member. Where the support member is integral with a larger frame unit, stiffening may be obtained by the connection of components of the frame unit to the support member.

Preferably, at least one edge of the plate is configured to allow frame units to be stacked onto the plate. For example, it may be configured without a wall. Alternatively, it may be configured with a wall which is movable from a first position in which it will not prevent frame units being moved onto the plate member and a second position in which it extends at an angle to the plane of the plate member, to give added strength. For example, it may be a hinged wall or a removable wall member. Fixing means may be provided to fix the movable wall in the second position, the first position or both.

Alternatively, a ramp member may be provided.

The support member is preferably provided with lifting points, for engaging lifting means. For example, the lifting means may comprise the forks of a forklift truck. The lifting points may comprise hooks, loops, recesses, slots, tubes or other suitable structures for engaging the lifting means, for example the forks of a forklift truck.

Where there is a plurality of frame units having a largest frame unit and a smallest frame unit, the support member is preferably integral with the largest frame unit, comprising at least a part of the floor contacting portion of the largest frame unit and preferably being the floor contacting portion of the largest frame unit.

In a preferred embodiment, the support member is configured so that it supports the floor contacting portions of respective frame units when the frame units are stacked. For example, if the frame units comprise at least one roller or wheel, the roller or wheels of respective frame units are preferably all supportable by the support structure or support member when stacked.

Preferably, the support member comprises receiving means for receiving the floor contacting portions of respective frame units. For example, the support member may comprise means for guiding the floor contacting portions as they are stacked. The support member may comprise tracks, slots and/or guiding walls for receiving and/or guiding the floor contacting portions of respective frame units.

The support member may comprise at least one additional support structure extending away from the support member. Preferably, the additional support structure is for supporting at least one deck of a rostrum. The additional support structure may be for engaging frame units stacked with respect to the support member in the stacked position.

The additional support structure may define at least one side face and/or a rear face of a framework for receiving stacked frame units. In this case the rostrum support structure may comprise a movable or removable gate for closing a front face of the framework, the gate being movable or removable to allow frame units to be stacked.

The gate may be hingedly mounted with respect to the framework, and may be hinged so that it folds down onto the floor.

The gate may comprise at least one first gate panel and at least one second gate panel, the second gate panel being configured to fold onto the first gate panel, so that, when folded onto the floor, the second gate panel does not obstruct the movement of the frame units out of the framework.

The external dimensions of the framework preferably do not exceed those of a standard shipping container, so that it can be transported easily.

The additional support structure may support at least one frame unit when stacked. For example, the additional support structure, which suitably extends vertically, in use, may have an inwardly directed support, for example a lug, which engages with the at least one frame unit and/or deck supported on the frame unit when stacked. For example, the support may extend inwardly from at least one side of the framework. It may extend inwardly from the rear of the framework. The support may comprise a lug or bracket. It may comprise a first member which extends horizontally in use for receiving an underside of a respective component of a frame unit and/or deck supported on a frame unit and a second member which extends substantially horizontal in use for engaging a top part of the respective member or deck. In this way, a particularly strong support for the frame unit and/or deck can be provided.

It is particularly valuable to be able to provide strong support for each of the frame units and/or decks in the stacked position, so that they are protected during transport. Transport and movement of the stacked units can expose them to shock loads and vibrations and it is beneficial to provide reinforcement and support to prevent them moving with respect to one another and with respect to the support member.

A frame unit and/or deck engaged with the frame unit may comprise a member extending from a front edge thereof for engaging a part of a gate when a gate is in the closed position, to provide further support for the stacked structure.

Where there is a largest frame unit and at least one smaller frame unit receivable in the larger frame unit and the extent of the support member in the retraction direction exceeds the retraction travel of the smaller unit within the larger unit, the size of the respective floor contacting portion of the frame unit which is immediately receivable in the largest frame unit will preferably have a vertical dimension which allows for the fact that it is always in contact with the support structure or support member. However, other frame units will have a total travel out of the largest frame unit and immediately smaller frame unit which is greater than the extent in the retraction direction of the support member and so, in the extended position, will be expected to contact the floor directly and their floor contacting portions should be dimensioned accordingly.

Preferably there is a single support member or support structure for all frame units.

Any suitable means may be provided for fixing the frame units in the retracted position and/or the extended position.

For example, the gate referred to above may be configured to fix the frame units in the retracted position.

The support member may comprise at least one movable edge, movable between a first position in which it does not prevent movement of frame units with respect to the support member and a second position in which it can prevent movement of the frame units with respect to the support member. This provides a way of fixing the frame units on the support member in a position suitable for transport.

The frame units are preferably stackable one into another.

The frame units preferably comprise at least one substantially vertically extending structure, extending from at least one floor contacting portion (for example a foot structure), for providing a mounting for at least one deck. The vertically extending structure suitably comprises a deck support structure which may extend in the direction in which the units are stacked.

The vertically extending structure may have any suitable configuration, for example an A shape or an inverted V. The rostrum support structure may be as described in WO2008/149077 or GB 2474295, with the addition of at least one support member according to the invention.

The vertically extending structure may comprise at least two vertically extending structure units. They may be connected by a transverse linking member. The vertically extending structure units, optionally with the transverse linking member, may form a triangulated structure for strength or a trapezoidal or rectangular structure. The vertically extending structure may have at least one vertical face, the transverse linking member being mounted adjacent the vertical face. In this way, the space between the vertically extending structure units can be left free to provide a space in which other frame units can be received.

The rostrum support structure may comprise a plurality of frame units which are spaced apart in a direction substantially transverse with respect to the direction in which units are stacked, as shown in WO2008/149077 or GB 2474295 or they may comprise a frame unit which has substantially the same lateral extent as a deck to be supported.

In the rostrum support structure, there are at least two frame units, but there may be for example five units or more, possibly ten units or more. Where there are a plurality of frame units, there is a largest frame unit and a smallest frame unit, the plurality of frame units forming a set of frame units, each frame unit apart from the largest being retractable and nestable into a larger frame unit and all frame units except the smallest frame unit being capable of receiving a smaller frame unit retracted thereinto. A larger frame unit, for example the first frame unit, preferably defines an internal shape and a smaller frame unit (for example a second frame unit) defines an outer frame shape which is geometrically similar to and slightly smaller than the internal shape of the larger frame unit.

Each floor contacting part preferably comprises a structure for travelling over a floor surface, for example a sliding surface (such as a skid), wheel or roller.

Each frame unit preferably extends up to and no further than a level at which a deck is to be supported, in order to avoid the presence of upwardly extending members above the respective deck. However, in some cases a respective frame unit may extend beyond this level to provide a support, for example for a handrail or side guard.

At least one, or each, frame unit preferably comprises at least one foot extending from the floor contacting part, for maintaining the respective frame unit in an upright position. The foot preferably extends in a direction substantially parallel to the retraction direction. Each foot of each frame unit may be nestable and retractable adjacent the respective foot of an adjacent frame unit. Preferably, each frame unit comprises a foot extending from each of two floor contacting parts, one on either side. Preferably, the feet of a smaller frame unit are located between the feet of a larger frame unit in the retracted position. In one embodiment, the smallest frame unit comprises feet which are located outside the feet of larger frame units, to provide extra stability on this part which, in the extended position, will be furthest from the largest frame unit. The feet of the smallest frame unit may be in addition to ones which are located between the feet of the immediately larger frame unit. Wheels may be provided at at least one end and preferably at both ends of a respective foot to aid sliding over a floor structure.

Stop means may be provided to control movement of a respective frame unit with respect to larger or smaller frame units. A stop means may comprise a latch means for fixing the frame units in the extended position.

Where the frame units are stackable, a restraint may be provided to hold them when in the stacked position. Any suitable restraint may be used. For example, a ratchet latch of the type known for strapping loads onto goods vehicles may be used. A gate as described above may be used.

If the frame units comprise wheels, fixed or removable means such as chocks may be provided on the support member to prevent rolling of the units out of the stacked position.

A deck support may be provided extending from a respective part of a frame unit, for supporting a deck. Suitably, the deck support extends from the respective frame unit in a cantilever fashion. Preferably, the deck support extends in a direction which, in use, is substantially horizontal. Preferably, a deck support extends from each rostrum support structure point. Alternatively, the deck support may comprise at least one beam which extends generally normal to the retraction direction. The beam is suitably formed of a material or structure for providing strength in this direction. For example, it may comprise an I-beam of a square section beam or a T-beam. The deck may be supported on deck supports which extend, for example in the retraction direction, from the beam. Alternatively, the deck may be suspended from the beam. Respective deck supports of adjacent frame units are preferably configured so that they do not prevent retraction of a smaller frame unit into a larger frame unit.

Each deck support may be independently adjustable in height and/or angle with respect to the frame unit from which it extends, so that a deck supported by it can be made level. Preferably, a deck support comprises a contact member for contacting a deck or a frame unit located immediately below the frame unit to which the deck support is attached. In this way, an improved support of weight applied to the deck on the deck support can be obtained. Means may be provided to enhance sliding between a deck support and the deck or frame unit of an adjacent frame unit. For example, sliding surfaces or a roller may be provided. A roller may be provided on the underside of the deck support or on the top of the respective frame unit. Preferably, each rostrum support point comprises a bracket, the bracket comprising a sliding surface or roller, over which a first deck or deck support of another frame unit may slide or roll and a support point for adjustably supporting the a second deck. The bracket may also comprise a mounting member, for supporting a riser. A riser comprises a substantially vertical surface extending between adjacent decks, to close the space between the adjacent decks.

In the rostrum of the invention, there are at least two frame units, each supporting a respective deck. Each deck may be constructed from known materials, in a known fashion. In an embodiment of the invention, at least one deck has at least one curved edge when seen in plan. Suitably, all decks have at least one curved edge. Both front and back edges may be curved. Each deck may define a section of arc. In this way, a curved rostrum can be assembled. The rostrum units in this case suitably move in a direction substantially parallel to the radial direction of the section of arc at the centre of the deck.

However, in a preferred embodiment, the decks may have a longer rear edge and a shorter front edge. They may be substantially trapezoidal in plan.

With decks of this form, each succeeding deck may be smaller than the one before it. In this way, when extended, the decks can define or approximate to a section of a wedge.

If at least two separate rostra having such a form are placed next to one another, they can approximate a curved auditorium.

Preferably, where at least two rostra of this form are placed next to one another, the decks are configured so that the edges touch or abut one another along the whole of their depth. In this way, formation of gaps between rostra can be minimised, as such gaps can be dangerous.

In an embodiment in which the decks have a width which, in the direction normal to the retraction direction, gets smaller from one deck to the other, the number of seats mounted on lower decks may be reduced compared to those on upper decks.

Seats may be mounted on each deck or each frame member, in a manner known in the art.

In an embodiment in which the decks get smaller in the transverse direction, and in which beams are provided for supporting the decks, the beams also get smaller in the transverse direction from one frame unit to another. In this case, in the stacked position, the beams may not reach the side parts of a framework defining the largest frame unit. For this reason, it may not be possible to have support structures mounted on the sides of the framework.

Similarly, in the extended position, it may not be possible for support structures to extend from the sides of the framework to support the largest movable frame unit which is received in the framework and it may be preferable to provide a support structure which extends from a top beam of the front edge of the framework.

Seats may be provided, mounted on the decks or on the frame units. The seats may be detachable in the stacked position or they may fold into a storage position on top of the respective deck in the storage position. This can be achieved in a manner which is known in the art.

Each frame unit, vertically extending structure unit, transverse linking member or other structure may be formed of any suitable structure as will be known to the person skilled in the art. For example, they may independently comprise tubes, girders, I beams, T-section beams, solid beams or any other suitable structural unit. They may be made of any suitable material, for example wood or metal. Preferably, they are formed of steel or aluminium.

The rostrum support structure of the present invention may incorporate a latch, for example as described in GB 2474295.

Each support structure may be completed, assembled and designed off site and be brought to the location in which the rostrum is to be assembled, more easily than conventional nested system, because each support structure is modular.

BRIEF DESCRIPTION OF THE DRAWINGS

The present invention will be described further below by way of example only with reference to the accompanying drawings, in which.

DESCRIPTION OF PREFERRED EMBODIMENTS

Figure 1:
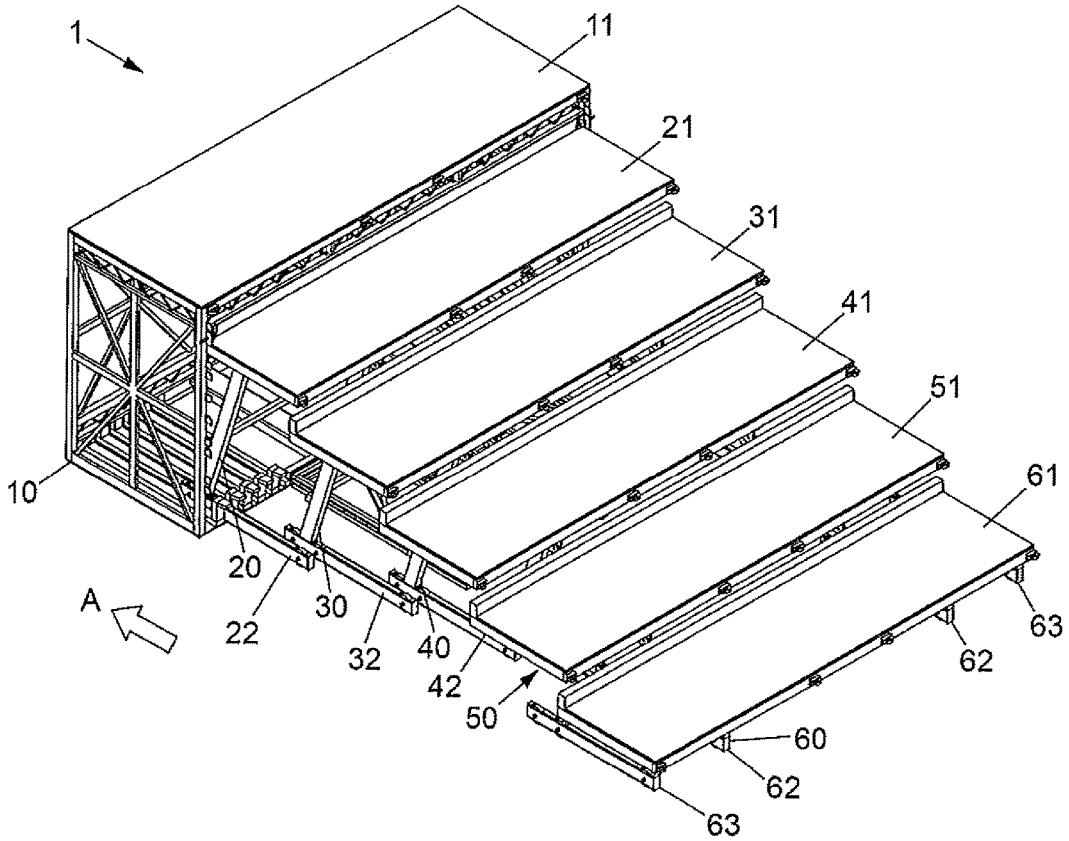
FIG. 1 is a sketch isometric view of a rostrum comprising a rostrum support structure according to the present invention.

FIG. 1 shows a rostrum generally designated 1.

Figure 3:
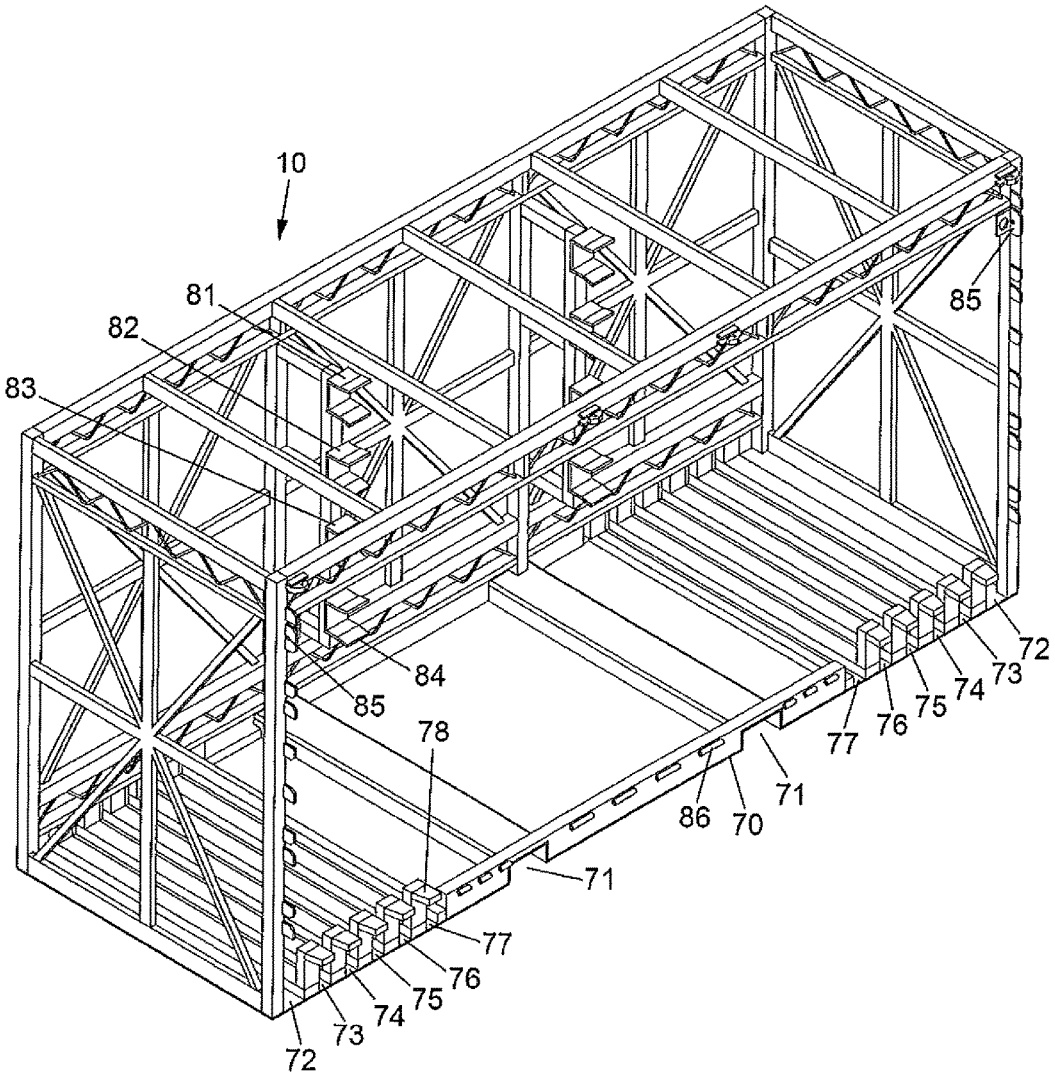
FIG. 3 is a sketch isometric view of a largest frame unit of the rostrum support structure of FIG. 1.
Figure 4:
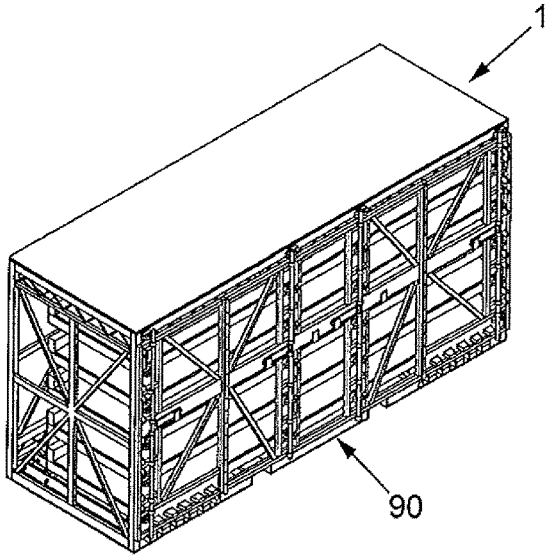
FIGS. 4-8 show steps in the assembly of a rostrum as shown in FIG. 1 from the stacked position to the open position.

The rostrum comprises a largest frame unit 10, into which successively smaller frame units 20, 30, 40, 50 and 60 can be stacked into the stacked position which is shown in FIG. 4. Each frame unit is engaged with a respective deck 11, 21, 31, 41, 51 and 61 to provide a completed rostrum. The largest frame unit (or first frame unit) 10 will be described further below with reference to FIG. 3. As can be seen from FIG. 2, each of the other, movable, frame units 20, 30, 40, 50, 60 comprises a respective vertically extending structure 27, 37, 47, 57, 67 which extends from a floor contacting member having a foot 22, 32, 42, 52, 62 which is provided with wheels so that it rolls smoothly on the ground. As can be seen in FIG. 1, the feet of each successively smaller frame unit 20-50 are located, in a direction normal to the retraction direction (indicated by the arrow A in FIG. 1) inside the feet of the immediately larger frame unit. However, the lowest frame unit is provided with two feet 62 which are located inside the feet 52 (not visible of frame unit 50) and also an extra, outer pair of feet 63 for supporting and protecting the outermost edge of the lowest frame unit 60, which is particularly vulnerable and exposed.

Each vertically extending structure 27, 37, 47, 57, 67 comprises a deck support in the form of a bracket 24, 34, 44, 54, 64 which is connected to a support beam 35, 45, 55, 65 from which the respective deck 31-61 is suspended. The beams 35, 45, 55, 65 provide lateral strength in the direction normal to the retraction direction A. They are formed in steel of square sectioned girders. The decks 11, 21, 31, 41, 51 and 61 are of conventional design and will not be described further.

The brackets 34, 44, 54, and 64 comprise a roller 36, 46, 56, 66 on top, over which the immediately adjacent deck 21, 31, 41 and 51 rolls when the frame units are being stacked with respect to one another.

The positions of the decks with respect to the brackets can be adjusted by adjusting means which shall not be described further, in a manner known in the art. A latch or fixing means may be provided for fixing any or each of the frame units in the extended position shown in FIG. 2. The latch may be as described in GB 2474295.

When desired, the latch (if present) is released and the frame units are stacked by moving each one in the direction A so that each respective frame unit is received within the immediately larger frame unit.

The vertically extending structures 27, 37, 47, 57 and 67 are designed to fit within one another so that they stack neatly together.

It should be noted that the extra feet 63 are suspended directly from the deck 61 so that they do not prevent stacking of the respective vertically extending structure 67 within the larger structure 57.

Figure 2:
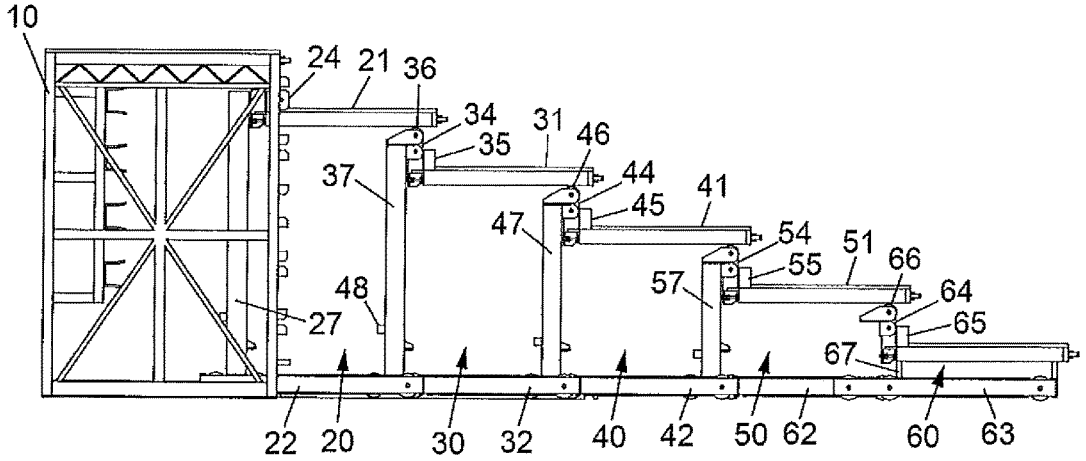
FIG. 2 is a sketch side elevation of a rostrum comprising a rostrum support structure according to the present invention.
Figure 9:
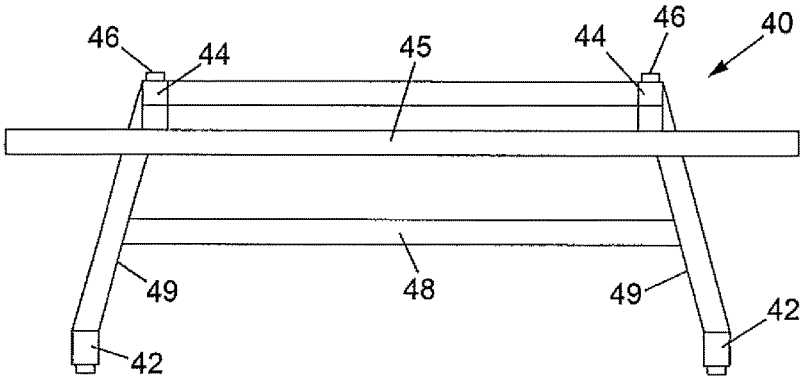
FIG. 9 is a schematic front view of the fourth frame unit.

FIG. 9 shows a schematic front view of one of the frame units, in particular the fourth frame unit 40. The feet 42 can be seen. The vertically extending structure 47 comprises a pair of vertically extending members 49 which tilt inwards, slightly in the vertical direction. They are linked by a transverse linking member 48. As can be seen in FIG. 2, the transverse linking member 48 is fixed to the vertically extending units 49 on a rear face rather than between them. As a result, when the units are stacked, respective transverse linking members, including 48, come to rest adjacent one another rather than obstructing one another. Also visible in FIG. 9 are the brackets, of which there are two, 44 and the beam 45 from which the respective deck is suspended. It is noted that, the frame unit shown in FIG. 9 comprises a trapezoidal structure rather than a triangulated one. This will be suitable in cases where the rostrum is relatively small. However, if the rostrum is relatively large, triangulated structures of the types shown for example in GB 2474295 or WO 2008/149077 may be used.

FIG. 3 shows a sketch isometric view of the first frame unit 10.

The first frame unit 10 is unlike all the other frame units in structure, as it comprises a framework box made of steel girders which are fixed together, for example by bolting, riveting or welding. The framework defines an opening into which all the other frame units are stacked. The floor contacting surface of the framework comprises a support member 70 in the form of a formed steel plate. The support member 70 is of depth in the retraction direction A sufficient to completely receive the stacked frame units 20, 30, 40, 50, 60. It is of width in a direction normal to the retraction direction A sufficient to enclose them.

The framework provides a strong, protective cage which allows the frame units to be held securely and safely in a manner in which they are easy to transport.

The support member comprises two channels 71 for receiving the forks of a forklift truck, so that the stacked rostrum support structure can be lifted and transported by a forklift truck.

The support member comprises a plurality of channels 72, 73, 74, 75, 76 and 77 symmetrically disposed, on each side, into which respective feet 63, 22, 32, 42, 52 and 62 are received. The slots are defined by upstanding walls so that they receive and guide the feet while the frame units are being retracted and hold them securely in position when the frame units are stacked. At the front edge of the support members 70, there are in total 10 upstanding supports 78. The projections 78 engage with corresponding slots 79 formed in gate panels which are shown below and described further below in FIG. 10.

The framework of the frame unit 10 defines two side walls and a rear wall. The front face, into which the frame units move when stacking, is open. It can be seen that the rise necessary for the rollers of the feet to enter their respective slots 72-77 is very small, so that retraction is easy. The rear and side edges of the support member 70 are formed of upturned edge structures in the form of flanges, to give the support member strength against bending.

A plurality of pairs of brackets 71, 72, 73 and 74 can be seen projecting from the rear face of the framework. Each of the brackets comprises a first horizontally extending member and a second horizontally extending member with a slightly flared opening, into which the respective deck of the second frame unit, third frame unit, fourth frame unit or fifth frame unit is received in the retracted position. The brackets hold and support the respective decks in the stacked position, to further provide safety and strength.

Adjacent the top of the open front edge, a pair of latches 85 are provided, together with latch pins which engage corresponding structures (not shown) on the second frame unit 20 to hold it in the extended position when it is rolled out of the first frame unit 10.

Also visible in FIG. 3 are hinge components 86, of which one is indicated. This provides a hinge on which the gate panel described in FIG. 4 is mounted.

Figure 5:
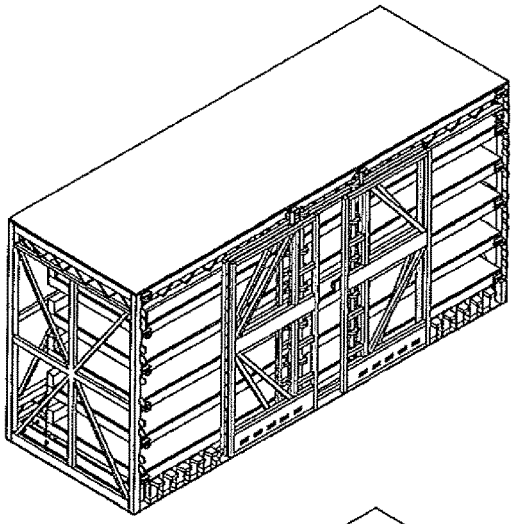
Figure 6:
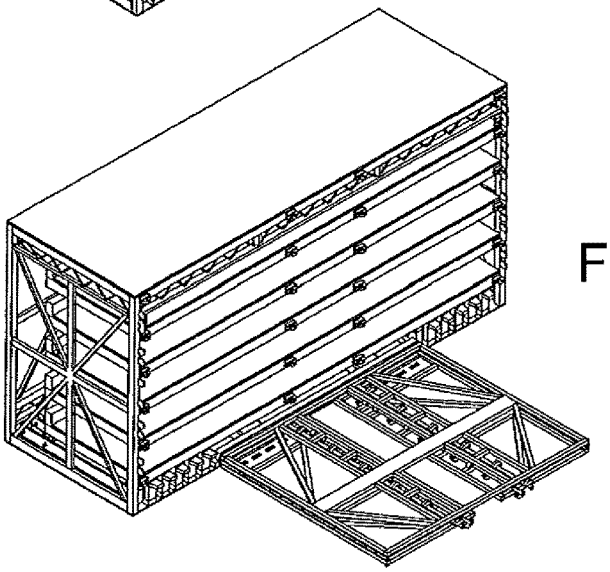

FIG. 4 shows a rostrum 1 corresponding to the one shown in FIG. 1, but in its stacked and closed position. In FIG. 4, the front face of the first frame unit 10 is shown closed by a gate generally designated 90. The gate 90 is described in more detail with reference to FIG. 10. The panel comprises an open planar framework. As can be seen more clearly in FIG. 10, the gate 90 comprises a first gate panel 91. The first gate panel 91 is mounted on hinges which engage the hinge portions 86 along its lower edge, so that it can fold downwardly as shown in FIG. 6. The gate 90 further comprises two further gate panels 92 and 93 which are mounted by piano hinges 94 to the first gate panel so that they can be folded flat against the first gate panel as shown in FIG. 5.

Closures are provided in the form of lockable bars 95 for holding the gate panels in position when they are closed. The lockable bars may suitably be of a type known for closing containers.

Figure 10:
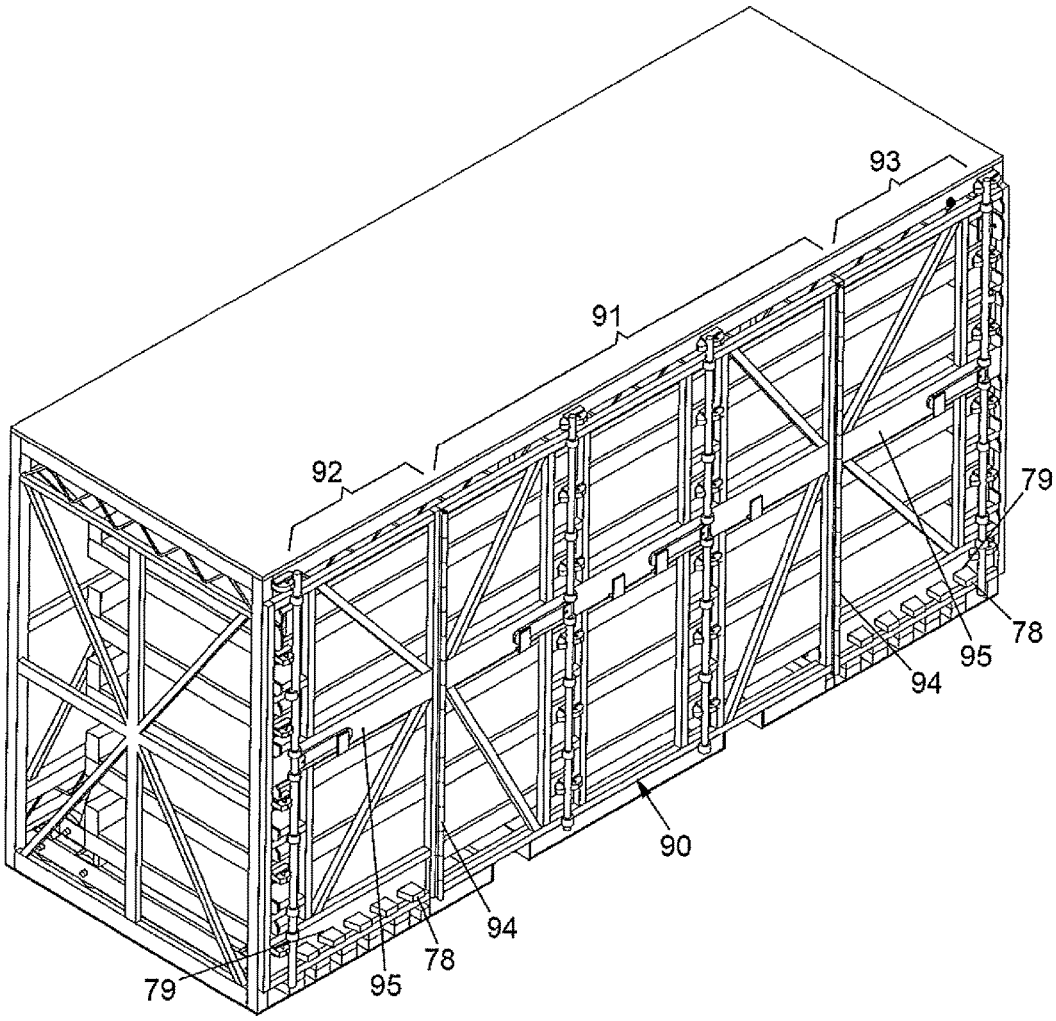
FIG. 10 is a sketch isometric view of the rostrum of FIG. 1, in the closed position.

It should be noted from FIG. 10 that the projections 78 can be seen projecting through respective slots 79 which are formed in panels on the lower edges of the further gate panels 92 and 93. In this way, when the stack is lifted, for example using a forklift truck, a supportive load is transferred through the support member 70, through the projections 78, to the respective gate panel 92 which bears against the underside of deck 11 on top of the first frame member 10, providing a rigid support for the deck 11 during lifting.

Starting from the closed and stacked position shown in FIG. 4, in order to assemble the rostrum, it is first of all necessary to release the lockable bars in a manner known to the person skilled in the art. The further gate panels 92 and 93 are then folded inwardly so that they lie flat against the first gate panel as shown in FIG. 5. The first gate panel is then rotated downwardly about the hinged parts 86 so that it lies flat on the ground in front of the stacked frame units.

Figure 7:
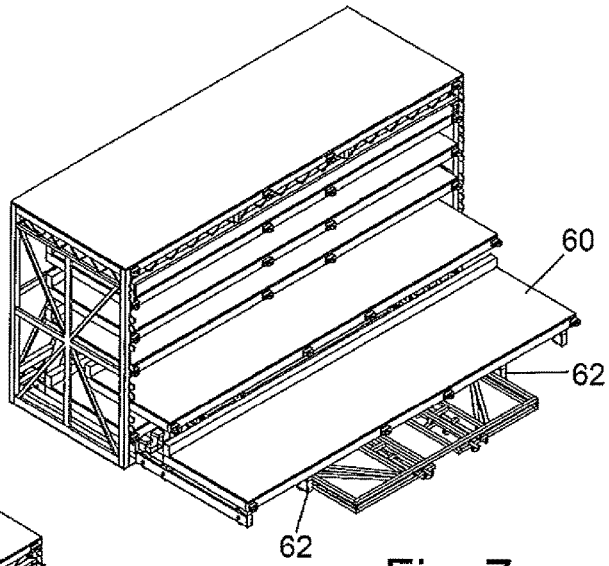
Figure 8:
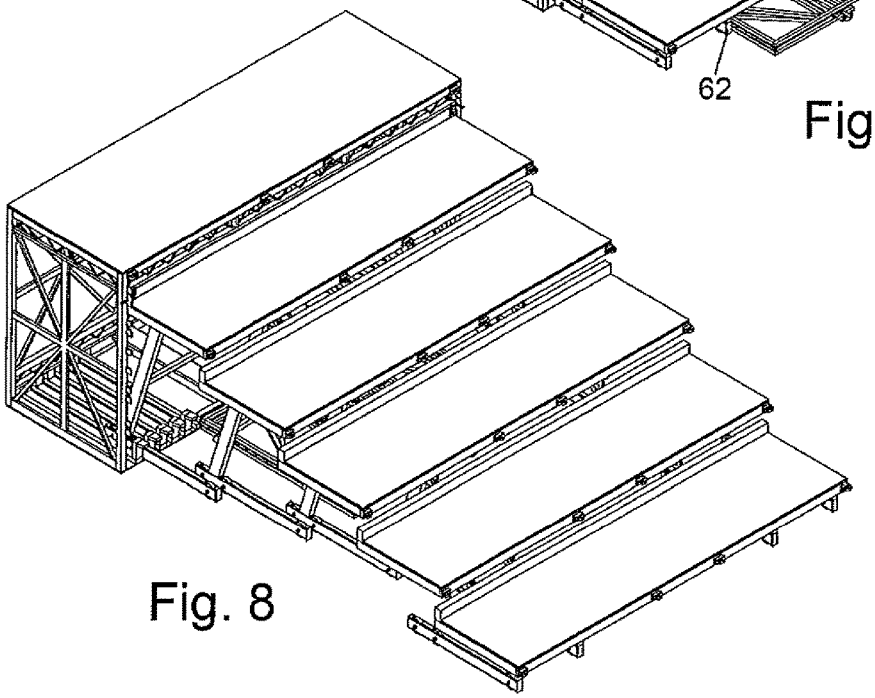

As shown in FIG. 7, the frame units are successively rolled out of the stacked position. The width of the first gate panel is configured so that it is smaller than the distance separating the feet 62 of the lowest frame unit 60, so it does not obstruct it rolling out. Rolling out continues until the fully assembled rostrum is assembled as shown in FIG. 8. It can then be latched into position by a latch mechanism, which is not shown.

To stack and close the rostrum, the corresponding members are moved in the opposite directions in the reverse sequence.

Figure 11:
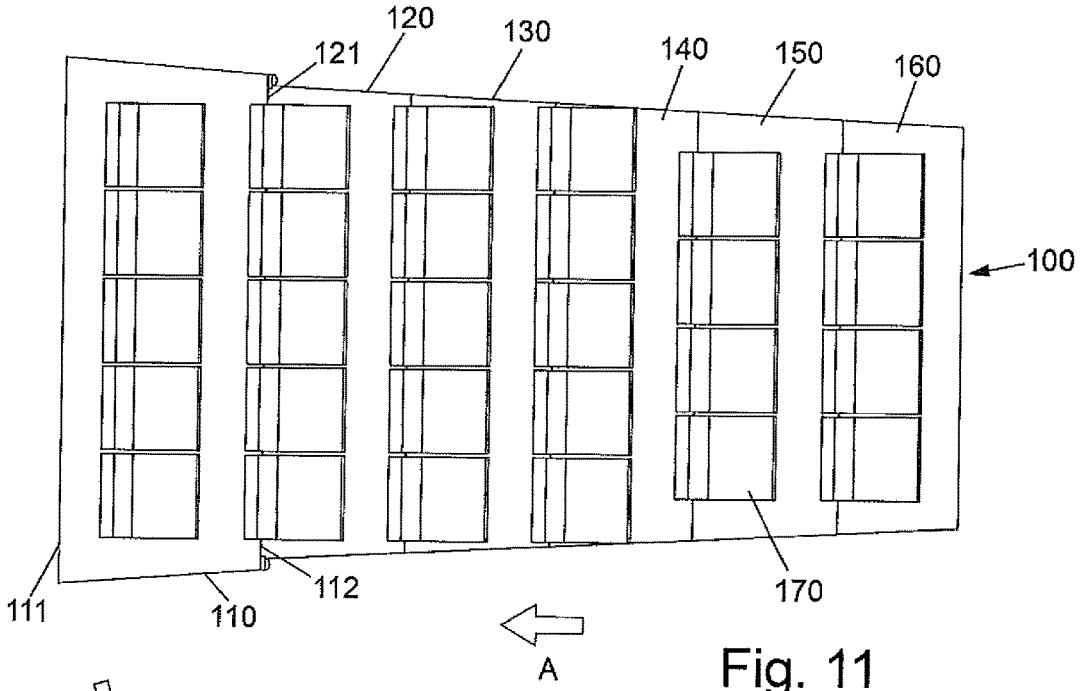
FIG. 11 is a schematic plan view of a further embodiment of rostrum according to the invention.
Figure 12:
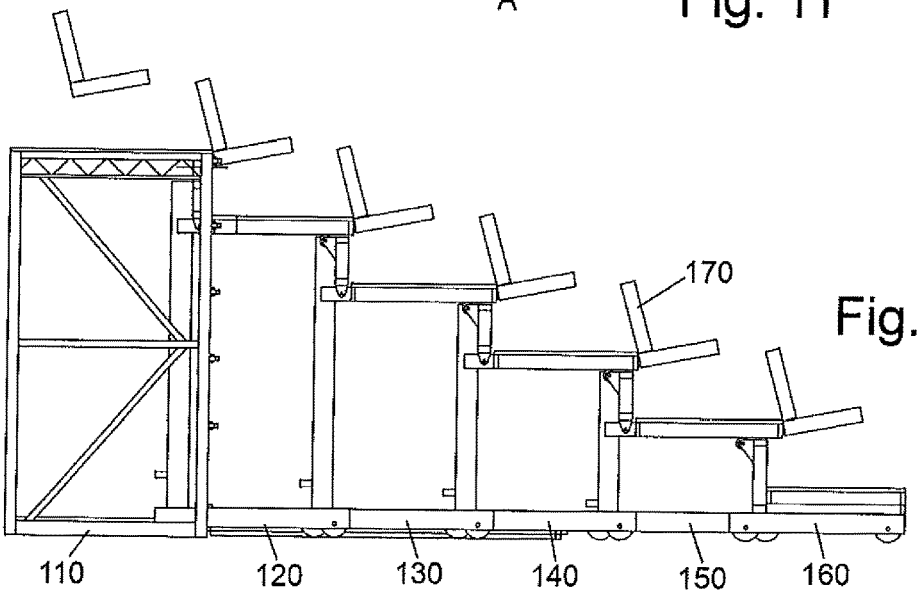
FIG. 12 is a schematic side view of the rostrum of FIG. 11.

FIG. 11 is a schematic plan view of a further embodiment of rostrum according to the present invention.

In this embodiment, there is a first frame unit 110 which is substantially as the first frame unit 10 of the embodiment shown in FIG. 1, except that, in plan view, the framework and the deck have a trapezoidal plan, with a rear edge 111 which is longer than a front edge 112. Similarly, there are a plurality of movable frame units 120, 130, 140, 150 and 160. Each of these has a deck with a trapezoidal plan. The rear edge 121 of the largest movable frame unit is slightly shorter in the direction normal to the retraction direction A than the front edge 112 of the first frame unit 110. Each succeeding frame unit has a rear edge which is the same size as, or slightly smaller than the front edge of the frame unit into which it is received in the stacked position.

A plurality of seats 170 are shown. It can be seen that in the two lowest decks 150 and 160, a smaller number of seats 170 are accommodated. The seats may be of a folding design which folds flat onto the respective deck before the frame units are moved into the stacked position.

Apart from the plan, the construction of the frame units and decks are substantially as shown in the embodiment of FIG. 1 and will not be described further.

Figure 13:
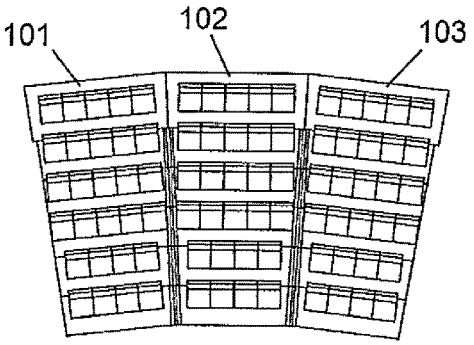
FIG. 13 is a schematic plan view of three rostra, each according to FIG. 11, mounted side by side.

As shown in FIG. 13, if three rostra 101, 102 and 103 are placed side by side with respect to side edges substantially touching, the rostra can together approximate a section of an arc shaped auditorium which is focused on a stage (not shown) or arena.

The present invention has been described above purely by way of example and modifications can be made within the spirit of the invention, which extends to equivalents of the features described. The invention also consists in any individual features described or implicit herein or shown or implicit in the drawings or any combination of any such features or any generalisation of any such features or combination.

What is claimed is:

1. A rostrum support structure comprising a plurality of frame units which can be stacked with respect to one another, at least one support member being provided for directly supporting at least two of the frame units when stacked so that they can be lifted together, wherein the at least one support member comprises a) a substantially flat plate, or b) a substantially flat structure comprising frame members extending in a direction parallel to the retraction direction and/or in a direction transverse to the retraction direction, and each frame unit having a floor contacting portion, wherein the support member comprises tracks or slots, the tracks or slots being arranged lateral to one another, and each track or slot being only wide enough and arranged to guide and receive only one floor contacting portion of only one respective frame unit during stacking and each track or slot being configured to hold a received floor contacting portion securely in position when the frame units are stacked.

2. A rostrum support structure according to claim 1, wherein the support member extends laterally relative to the direction in which frame units are stacked.

3. A rostrum support structure according to claim 2, wherein all of the frame units are supportable by the same at least one support member when the frame units are stacked.

4. A rostrum support structure according to claim 1, wherein the at least one support member comprises a member having substantial two dimensional extent.

5. A rostrum support structure according to claim 4, wherein the at least one support member has a depth in a direction which is parallel to a retraction direction in which frame units are moved to stack them, the depth being greater than or equal to the depth of at least one frame unit in the retraction direction.

6. A rostrum support structure according to claim 1, wherein the support member comprises at least one additional support structure extending away from the support member.

7. A support structure according to claim 6, wherein the additional support structure is for supporting at least one deck of a rostrum.

8. A rostrum support structure according to claim 6, wherein the additional support structure is for engaging frame units stacked with respect to the support member in the stacked position.

9. A rostrum support structure according to claim 6, wherein the additional support structure defines at least one side face and/or a rear face of a framework for receiving stacked frame units.

10. A rostrum support structure according to claim 1, wherein there is a plurality of frame units having a largest frame unit and a smallest frame unit, the at least one support member being integral with the largest frame unit.

11. A rostrum support structure according to claim 10, wherein the at least one support member comprises at least a part of the floor contacting portion of the largest frame unit.

12. A rostrum support structure according to claim 1, wherein the at least one support member is configured so that it supports floor contacting portions of respective frame units when the frame units are stacked.

13. A rostrum support structure according to claim 1, wherein there is a largest frame unit and at least one smaller frame unit receivable in the largest frame unit and the extent of the at least one support member in the retraction direction, being the direction in which frame units move to stack, exceeds the retraction travel of the smaller unit within the larger unit, the size of the respective floor contacting portion of the frame unit which is immediately receivable in the largest frame unit having a vertical dimension which allows for the fact that it is always in contact with the support structure or support member.

14. A rostrum support structure according to claim 1, wherein the frame units are stackable one into another.

15. A rostrum support structure according to claim 1, further comprising a support extending from a respective rostrum support structure point, for supporting a deck.

16. A rostrum comprising a rostrum support structure according to claim 1, wherein at least one deck is supported on each frame unit.

17. A rostrum support structure according to claim 1, further comprising a movable or removable gate for closing a front face of a framework for receiving stacked frame units, the gate being movable or removable to allow frame units to be stacked, wherein the gate is moveable or removable so that it can be placed on the floor.

18. A rostrum support structure according to claim 17, wherein, when the gate is placed on the floor, the outer edges of the gate provide tracks for guiding a frame unit as it moves from a retracted position, in which it is stacked, to an extended position.

19. A rostrum support structure according to claim 1, further comprising a movable or removable gate for closing a front face of a framework for receiving stacked frame units, the gate being movable or removable to allow frame units to be stacked, wherein the gate is moveable or removable so that it can be placed on the floor, wherein the gate can be folded so that its width is smaller than a distance separating the floor contacting portions of a smallest frame unit, so that the gate does not obstruct the smallest frame unit as it is extended.

20. A rostrum support structure comprising a plurality of differently sized frame units which can be stacked with respect to one another, at least one support member being provided for directly supporting at least two of the frame units when stacked so that they can be lifted together, further comprising a movable or removable gate for closing a front face of a framework for receiving stacked frame units, the gate being movable or removable to allow frame units to be stacked, wherein the gate is moveable or removable so that it can be placed on the floor, wherein the gate can be folded so that its width is smaller than a distance separating floor contacting portions of a smallest frame unit, so that the gate does not obstruct the smallest frame unit as it is extended.

* * * * *